US008375938B2

(12) United States Patent
Gaumond et al.

(10) Patent No.: US 8,375,938 B2
(45) Date of Patent: Feb. 19, 2013

(54) HYPERBARIC/HYPOXIC CHAMBER SYSTEM

(75) Inventors: Claude Gaumond, Lachine (CA); Gerard Lombard, Montréal (CA); Stéphan Gagnon, Laval (CA); Luc Garand, Rimouski (CA); Jean-François Goulet, Ste-Luce (CA)

(73) Assignee: Groupe Medical Gaumond Inc., Montreal (CA)

( * ) Notice: Subject to any disclaimer, the term of this patent is extended or adjusted under 35 U.S.C. 154(b) by 808 days.

(21) Appl. No.: 12/365,239

(22) Filed: Feb. 4, 2009

(65) Prior Publication Data

US 2009/0250063 A1 Oct. 8, 2009

Related U.S. Application Data

(63) Continuation of application No. PCT/CA2007/001365, filed on Aug. 3, 2007.

(60) Provisional application No. 60/821,442, filed on Aug. 4, 2006.

(51) Int. Cl.
*A61G 10/00* (2006.01)

(52) U.S. Cl. ..... 128/202.12; 128/205.26

(58) Field of Classification Search ..... 128/202.12, 128/205.26, 204.18
See application file for complete search history.

(56) References Cited

U.S. PATENT DOCUMENTS

| | | | | | |
|---|---|---|---|---|---|
| 2,366,067 | A | * | 12/1944 | Smith | 285/107 |
| 2,401,230 | A | * | 5/1946 | Colley | 5/413 AM |
| 2,448,546 | A | * | 9/1948 | Plemel et al. | 128/202.16 |
| 3,316,828 | A | * | 5/1967 | Boehmer | 454/238 |
| 3,447,572 | A | * | 6/1969 | Marsden, Jr. et al. | 138/141 |
| 3,877,427 | A | | 4/1975 | Alexeev et al. | |
| 5,060,644 | A | * | 10/1991 | Loori | 128/202.12 |
| 5,101,819 | A | | 4/1992 | Lane | |
| 5,188,099 | A | * | 2/1993 | Todeschini et al. | 128/205.26 |
| 5,255,673 | A | | 10/1993 | Cardwell et al. | |
| 5,618,126 | A | | 4/1997 | Watt | |
| 5,678,543 | A | | 10/1997 | Bower | |
| 5,685,293 | A | | 11/1997 | Watt | |
| 5,799,652 | A | | 9/1998 | Kotliar | |
| 5,899,846 | A | * | 5/1999 | Sternberg et al. | 600/21 |
| 5,964,222 | A | | 10/1999 | Kotliar | |
| RE36,958 | E | * | 11/2000 | Gamow | 128/202.12 |
| 6,321,746 | B1 | | 11/2001 | Schneider et al. | |
| 6,565,614 | B1 | | 5/2003 | Kutt et al. | |
| 6,779,523 | B2 | * | 8/2004 | Luppi | 128/205.26 |
| 7,100,604 | B2 | * | 9/2006 | Gurnee et al. | 128/202.12 |
| 2003/0074917 | A1 | * | 4/2003 | Kotliar | 62/640 |
| 2004/0255937 | A1 | * | 12/2004 | Sun | 128/201.25 |
| 2005/0056279 | A1 | * | 3/2005 | Linton | 128/202.12 |
| 2005/0161039 | A1 | * | 7/2005 | Gurnee et al. | 128/202.12 |

* cited by examiner

*Primary Examiner* — Loan Thanh
*Assistant Examiner* — Sundhara Ganesan
(74) *Attorney, Agent, or Firm* — Brouillette & Partners; François Cartier; Robert Brouillette

(57) ABSTRACT

A portable chamber for hyperbaric/hypoxic treatment comprises a tubular body sized so as to accommodate an occupant. The tubular body is made of a non-rigid material. End frames are secured to opposed ends of the tubular body to close off the tubular body. One end frame has a door displaceable from a remainder of the end frame to provide/close access to an interior of the tubular body. Longitudinal beam members are connected at opposed ends to the end frames so as to maintain the tubular body in a taut condition between the end frames, whereby the portable chamber is in fluid communication with a pressure generator so as to receive an air supply from the pressure generator to increase a pressure in the interior of the tubular body for hyperbaric treatment.

18 Claims, 4 Drawing Sheets

HYPERBARIC/HYPOXIC CHAMBER SYSTEM

CROSS-REFERENCE TO RELATED APPLICATIONS

This patent application is a continuation of PCT Patent Application PCT/CA2007/001365, filed Aug. 3, 2007, and claims priority on U.S. Provisional Patent Application 60/821,442, filed on Aug. 4, 2006.

FIELD OF THE APPLICATION

The present application relates to hyperbaric and hypoxic chamber systems and, more particularly, to hyperbaric chamber systems in which the hyperbaric chamber is primarily made of a non-rigid material so as to be portable.

BACKGROUND OF THE ART

Hyperbaric chamber systems are well known and used in the medical and sports industries. In essence, occupants of hyperbaric chambers undergo hyperbaric treatments in which they are subjected to relatively high pressures. Hyperbaric treatments are known, amongst other things, to enhance muscular recuperation, increase oxygen inhalation, etc. In hypoxic chambers, the occupant is subjected to lower oxygen contents, to simulate high altitudes. Hypoxic treatments are known, amongst other things, to stimulate the production of red blood cells.

Standard hyperbaric chambers are made of rigid materials capable of withstanding pressure differentials. Accordingly, hyperbaric treatments are not commonly accessible, and often limited to elite-level athletes and selected patients.

Accordingly, portable hyperbaric chamber systems have been created to become more accessible. However, proposed portable systems are generally not sturdy and therefore not durable. Moreover, hyperbaric chamber systems are often limited to hyperbaric treatments.

SUMMARY OF THE APPLICATION

It is therefore an aim of the present invention to provide a novel hyperbaric chamber system.

Therefore, in accordance with a first embodiment, there is provided a portable chamber for hyperbaric treatment comprising: a tubular body sized so as to accommodate at least one occupant, the tubular body being made of a non-rigid material; end frames secured to opposed ends of the tubular body to close off the tubular body, with at least one of the end frames having a door displaceable from a remainder of the end frame to provide/close access to an interior of the tubular body; and at least one longitudinal beam member connected at opposed ends to the end frames so as to maintain the tubular body in a taut condition between the end frames; whereby the portable chamber is in fluid communication with a pressure generator so as to receive an air supply from the pressure generator to increase a pressure in the interior of the tubular body for hyperbaric treatment.

Further in accordance with the first embodiment, there are two of the longitudinal beam member, with each of the longitudinal beam member being extendable to an extended position in which the tubular body is in the taut condition.

Further in accordance with the first embodiment, the portable chamber comprises a locking mechanism to lock at least one of the longitudinal beam members in the extended position.

Further in accordance with the first embodiment, the portable chamber according to claim 1, wherein the at least one longitudinal beam member is separated from the end frames during transportation.

Further in accordance with the first embodiment, the tubular body has a frusto-conical geometry, with the end frame having the door being on a larger one of the end frames.

Further in accordance with the first embodiment, the end frames are nested one into another during transportation.

Further in accordance with the first embodiment, the tubular body has a cylindrical geometry, with the end frames each having a door.

Further in accordance with the first embodiment, the portable chamber comprising a support frame supporting the tubular body on the ground.

Further in accordance with the first embodiment, the support frame has a pair of shells being connected to form a case for transportation.

Further in accordance with the first embodiment, the support frame incorporates a pressure generator for providing the air supply to the chamber for hyperbaric treatment.

Further in accordance with the first embodiment, at least one of the end frames has ring-shaped bodies sandwiching a periphery of an open end of the tubular body, with the door being supported peripherally by the ring-shaped bodies.

Further in accordance with the first embodiment, the door has a see-through panel forming a window.

Further in accordance with the first embodiment, the portable chamber comprises handrails extending between end frames in the tubular body.

In accordance with a second embodiment, there is provided a hyperbaric chamber system comprising: a pressure generator; a portable chamber, sized so as to accommodate an occupant, the chamber being in fluid communication with the pressure generator so as to receive an air supply from the pressure generator to increase a pressure in the chamber for hyperbaric treatment; and a hypoxic generator for outputting air with a selected nitrogen/oxygen ratio, the hypoxic generator being in fluid communication with the chamber to adjust an oxygen content in the chamber for hypoxic treatment.

Further in accordance with the second embodiment, the hyperbaric chamber system comprises a case to accommodate the portable chamber in a collapsed condition during transportation, the case incorporating the pressure generator, the hypoxic generator and a control system controlling conditions in the chamber during hyperbaric/hypoxic treatments.

Further in accordance with the second embodiment, the hyperbaric chamber system comprises a oxygen source for outputting oxygen-rich air, the oxygen source being in fluid communication with the chamber to feed oxygen in the chamber.

Further in accordance with the second embodiment, the hyperbaric chamber system comprises a mask in the chamber, the mask being in fluid communication with the oxygen source to feed oxygen directly to an occupant of the chamber.

Further in accordance with the second embodiment, the chamber has a pair of end frames between a tubular non-rigid body, with the pressure generator, the hypoxic generator and a control system controlling conditions in the chamber during hyperbaric/hypoxic treatments being all connected to the end frames for fluid communication with an interior of the chamber.

In accordance with a third embodiment, there is provided a hyperbaric chamber system comprising: a portable chamber, sized so as to accommodate an occupant, the chamber being in fluid communication with a pressure generator so as to receive an air supply from the pressure generator to increase a pressure in the chamber for hyperbaric treatment, the portable chamber consisting of a non-rigid tubular body maintained in a taut condition by a collapsible structure; and a support frame supporting the tubular body on the ground, the support frame having a pair of shells being connected to form a case to accommodate the portable chamber in a collapsed condition for transportation.

Further in accordance with the third embodiment, the support frame incorporates the pressure generator, and a control system controlling conditions in the chamber during hyperbaric/hypoxic treatments.

DESCRIPTION OF THE PREFERRED EMBODIMENTS

Figure 8:
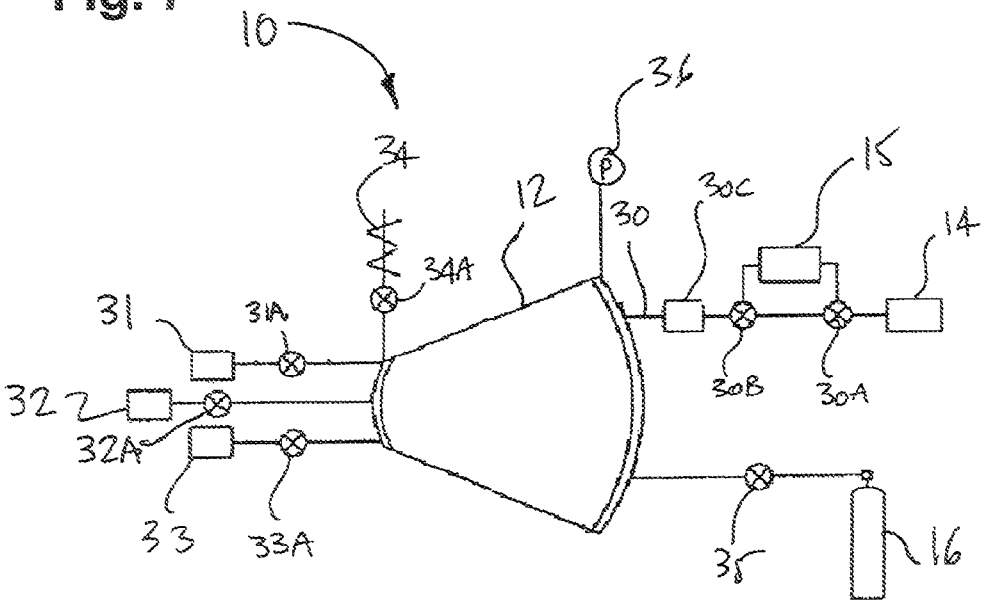
FIG. 8 is a schematic view of the hyperbaric/hypoxic chamber systems, showing a pneumatic system thereof.

Referring now to the drawings, and more particularly to FIGS. 1 to 6, a hyperbaric/hypoxic chamber system in accordance with a preferred embodiment is generally shown at 10. As is shown in FIG. 8, the hyperbaric/hypoxic chamber system 10 has a hyperbaric/hypoxic chamber 12, as well as various sources of air/oxygen to modify the conditions of air within the chamber 12 with respect to the ambient conditions outside the chamber 12. The various sources include a pressure generator 14, a hypoxic generator 15 and an oxygen source 16.

The chamber 12 accommodates a user person that will undergo a hyperbaric/hypoxic treatment.

The pressure generator 14 is in fluid communication with the chamber 12, and supplies the chamber 12 with pressurized air, in accordance with the desired treatment for the user person.

The hypoxic generator 15 is in fluid communication with the chamber 12, and supplies the chamber 12 with selected oxygen/nitrogen ratios below that of ambient air for hypoxic treatment.

The oxygen source 16 is in fluid communication with the chamber 12, and more preferably with a mask used by an occupant of the chamber 12 to supply oxygen-rich air to the occupant for instance during hyperbaric treatment.

Figure 1:
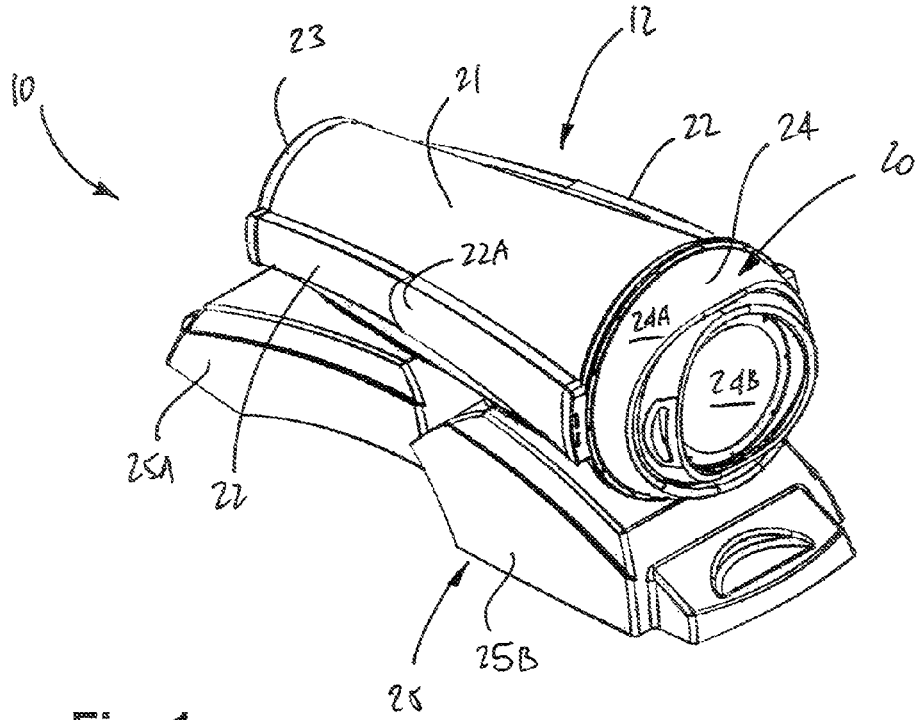
FIG. 1 is a perspective view of a hyperbaric/hypoxic chamber system in accordance with a first preferred embodiment of the present invention.

In the embodiment of FIG. 1, the chamber 12 has a generally frusto-conical shape with a larger extremity, the proximal extremity or end accommodating an upper body and head of the user person. The smaller extremity, the distal extremity or end, accommodates the lower body of the user (i.e., the legs and feet). An interior of the chamber 12 preferably has a circular cross-section.

The chamber 12 has a structure 20. The structure 20 serves as a skeleton that will hold together a non-rigid tubular body 21. In the embodiment of FIGS. 1 to 6, the structure 20 has a pair of longitudinal beam members 22, that are positioned on opposed sides of the body 21. The longitudinal beam members 22 are connected at opposed ends to an end frame 23 and to a door assembly 24 (i.e., another end frame with a door) of the structure 20. The end frame 23 and the door assembly 24 are sealingly secured to the body 21, whereby the longitudinal beam members 22 maintain the body 21 in a taut condition before use of the chamber 12 for hyperbaric/hypoxic treatment.

The longitudinal beam members 22 are optionally detachable/separable from the end frame 23 and the door assembly 24. Moreover, the longitudinal beam members 22 are foldable in two about a pivot 22A between a pair of segments of the longitudinal beam members 22. It is preferred to have the longitudinal beam members 22 snap and lock (by way of a releasable locking mechanism) to the extended position illustrated in FIGS. 1 and 2, to ensure that the beam members 22 keep the body 21 in the taut condition. In the embodiment of FIG. 1, the bottom of the non-rigid body 21 lies directly on a support frame 25.

The non-rigid tubular body 21 is generally made of an airtight cloth material. One suggested cloth material is a polyurethane elastomeric material enclosing aramid filaments that reinforce the elastomeric material. Other materials considered include other polymeric fabrics. Considering that the chamber 12 will be used for hyperbaric purposes, the material is designed so as to be capable of sustaining positive relative pressures without bursting. For positive relative pressures, the body 21 will structurally maintain its shape.

It is pointed out that the tubular body is essentially a hollow non-rigid body having both ends opened, whereby the end frames are used to close off the tubular body. The tubular body 21 is not limited to the frusto-conical shape of FIG. 1, or the cylindrical shape of FIG. 7, as other types of cross-sections and geometries could also be used for the tubular body 21.

Referring concurrently to FIGS. 1 to 6, the door assembly 24 is provided at the larger end of the conical body 21. The door assembly 24 forms a door by which the occupant enters/exits the chamber 12. It is also considered to provide doors at opposed ends of the chamber 12, for practical reasons, as will be illustrated in the embodiment of FIG. 7. Moreover, a pair of doors would facilitate the handling of the chamber 12 when it is folded away.

Figure 5:
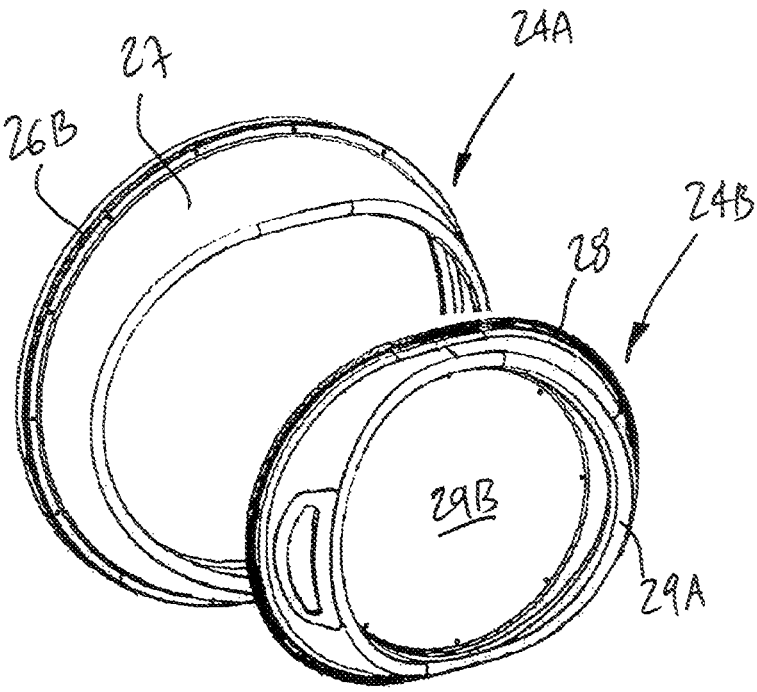
FIG. 5 is a two-part exploded view of the door assembly of FIG. 4.

As is shown in FIG. 5, the door assembly 24 has a frame 24A and a door 24B. The frame 24A is the interface between the door 24B and the non-rigid body 21. The door 24B is operatively mounted to the frame 24A and is manually displaceable from a remainder of the door assembly 24 to open and/or close access to an interior of the chamber 12.

The frame 24A is in fluid-tight connection with the non-rigid body 21. The interconnection between the frame 24A and the non-rigid body 21 must take into consideration the pressures to which the chamber 12 will be subjected. In one configuration, illustrated concurrently by FIGS. 4 and 6, the frame 24A has ring-shaped bodies, namely retainer ring 26A and a connector ring 26B positioned on opposed sides of a flange 21A of the non-rigid body 21. Accordingly, the flange 21A is sandwiched between the retainer ring 26A and the connector ring 26B. In one embodiment, the interconnection between the retainer ring 26A and the connector ring 26B is releasable while ensuring the fluid tightness of the non-rigid body 21 to the combination of the retainer ring 26A and the connector ring 26B. For instance, bolts, rivets or like fasteners are used to interrelate the retainer ring 26A to the connector ring 26B.

The door frame 27 is connected to the connector ring 26B. The door frame 27 is provided to support the door 24B, such that the door 24B can be secured to the frame 24A to close the access to the chamber 12, or pivoted or removed from the frame 24A to provide an access to an interior of the chamber 12. Accordingly, the door frame 27 has a casing body with a central opening in which the door 24B will be received. It is considered to permanently secure the door frame 27 to the connector ring 26B, so as to ensure the structural integrity of the frame 24A, as connected to the non-rigid body 21.

The door 24B has a see-through panel forming a window for visibility from or into the inside of the chamber 12. The door 24B has a window frame 28, as well as a window support 29A and a window panel 29B. The window frame 28 is operatively mounted to the door casing 27, for instance in pivoting engagement, and is displaceable between an opened and a closed position. A locking mechanism (not shown) is optionally provided between the door frame 27 and the window frame 28 to releasably lock the door 24B to the frame 24A, during treatment in the chamber 12. In order to secure the window panel 29B to the window frame 28, the window support 29A is provided, and holds the window panel 29B captive against the window frame 28.

The various components of the door assembly are made of a rigid material that can sustain the pressures related to hyperbaric treatments. For instance, it is considered to provide various parts of the door assembly 24 in a compression-molded glass/polypropylene composite. The window panel 29B is made of a transparent material, such as an acrylic material. It is considered to use materials that have a good rigidity-to-weight ratio, as the hyperbaric/hypoxic chamber system 10 is portable.

The elliptical periphery of the door 24B conveniently facilitates its insertion into the chamber 12 through the opening in the frame 24A. The door 24B is oriented such that the small axis of the door 24B is aligned with the large axis of the opening in the frame 24A for introduction of the door 24B in the frame 24A.

The end frame 23 is of similar construction as the door assembly 24 in the way it is connected to the non-rigid body 21, but does not have require a door, whereby the frame 27 is replaced by a closed-end casing (not shown).

Figure 7:
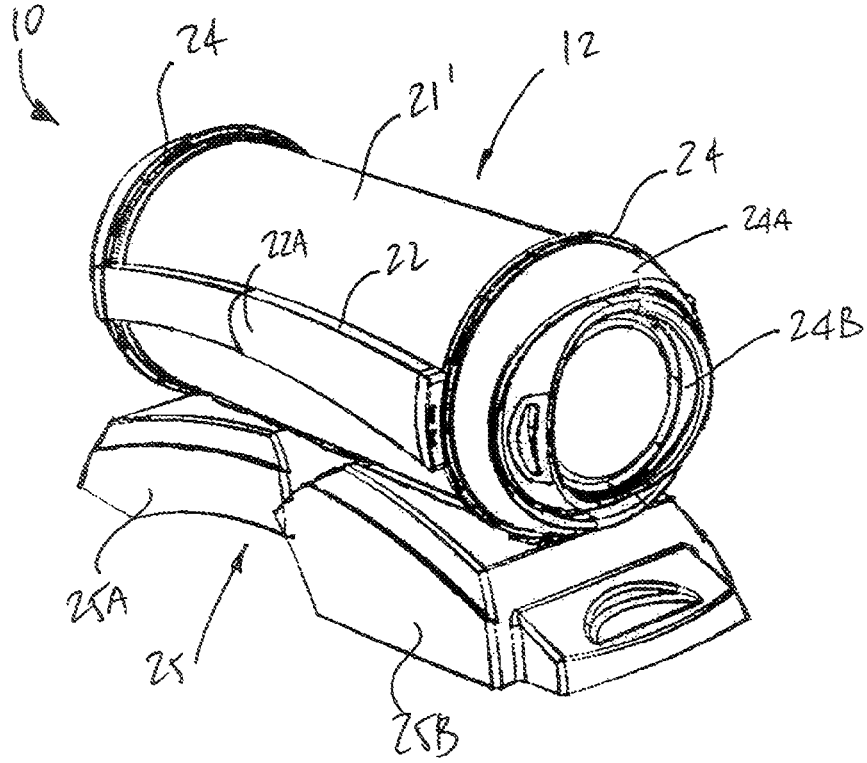
FIG. 7 is a perspective view of a hyperbaric/hypoxic chamber system in accordance with a second preferred embodiment of the present invention.

As is shown in FIG. 7, it is considered to provide the chamber 12 with a cylinder-shaped body 21'. In such a case, a pair of door assemblies 24 are provided at opposed ends of the body 21'.

Figure 6:
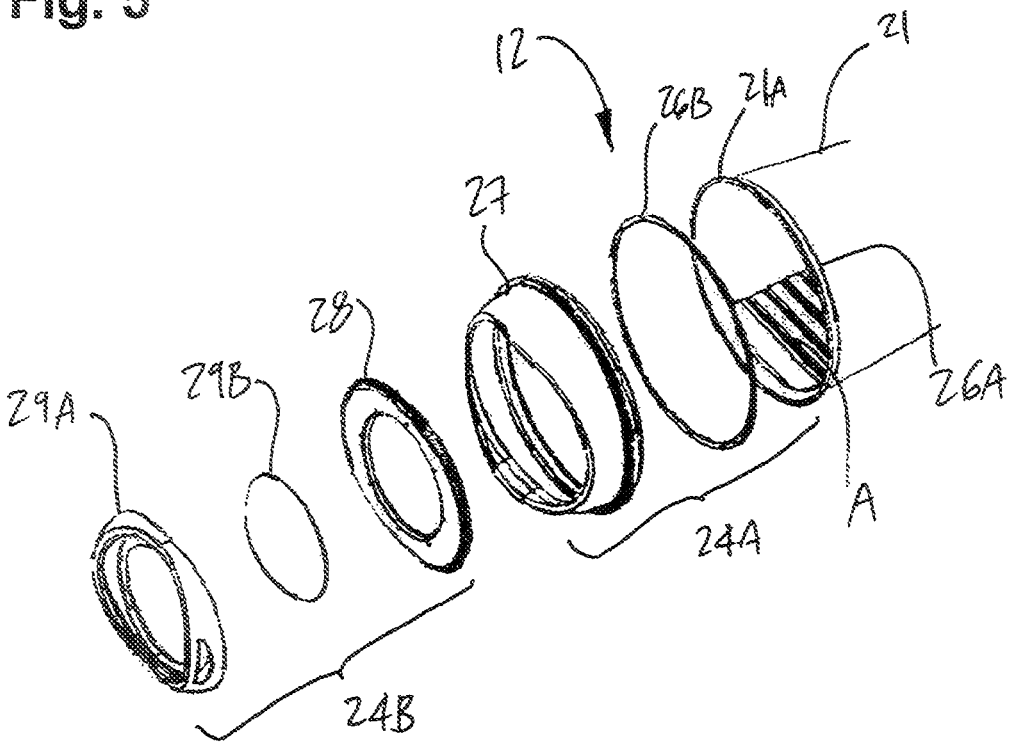
FIG. 6 is a multi-part exploded view of the door assembly of FIG. 4.

Referring to FIG. 6, a mattress A is typically provided within the chamber 12 so as to support the user person lying in the chamber 12 for treatment. It is additionally contemplated to provide the mattress with a hinged structure such that the user person may take a seated position within the chamber 12. The mattress (e.g., synthetic foam material or similar material that will not affect the oxygen level in the chamber 12) is shaped to as to be received in the bottom of the chamber 12.

In order to facilitate movements inside the chamber 12, it is considered to provide handrails extending from the end frame 23 to the door assembly 24. The handrails are for instance of telescopic configuration to facilitate transportation.

Referring to FIG. 8, a pressure inlet 30 is connected to the chamber 12. The pressure inlet 30 receives a pressure supply from the pressure generator 14 or a hypoxic output from the hypoxic generator 15, by being connected to the pressure generator 14 and hypoxic generator 15 by way of pneumatic piping (e.g., of air-breathing grade). The pressure inlet 30 has valves 30A and 30B that are adjusted to control the flow of air into the chamber 12, either from the pressure generator 14 or the hypoxic generator 15. To facilitate the connection of the pressure generator 14 and the hypoxic generator 15 to the pressure inlet 30, the pressure inlet 30 is preferably provided with a quick-coupling configuration.

An air content controller 31 is connected to the chamber 12, opposite the position of the pressure inlet 30. The air content controller 31 has a control valve 31A. The air content controller 17 has sensors to determine the level of parameters associated with the hyperbaric/hypoxic operations of the system 10, such as the carbon dioxide level, the oxygen level, the temperature and relative humidity.

An exhaust 32 having a valve 32A is part of and enables a circulation of air in the chamber 12, and is actuatable to release some pressure from the chamber 12. Because of the position of the exhaust 32, a flow of air is induced from the proximal extremity to the distal extremity of the chamber 12. This causes the exhaust of carbon dioxide from the chamber 12. Alternatively, a safety button inside the chamber 12 may be actuated to actuate an alarm.

A pressure control 33 and associated control valve 33A is also positioned on an outer surface of the chamber 12 An adjustment of the pressure is performed as a function of the reading from the pressure control 33, which actuates the valve 32A of the exhaust 32 in view of the desired pressure. When the treatment is over and it is desired to release the pressure from the chamber 12, the exhaust valve 32A is actuated to gradually release pressure.

A computer control system is optionally provided to ensure the suitable operation of the pressure generator 14, the hypoxic generator 15 and the oxygen source 16, by receiving data from the air content controller 31 and the pressure control 33 and commanding the various valves as a function of the data obtained from these sensors. The computer control system serves as an interface between the chamber system 10 and the user such that specific hyperbaric and hypoxic treatments are programmed for subsequent use of the chamber system 10. Alternatively, all valves may be mechanically actuated and controlled.

Also, other sensors may be provided in order to monitor the condition of the user of the chamber system 10. With such sensors providing data to the computer control system, the air content controller 31 and various valves are actuatable from signals of the computer control system when abnormal readings are obtained, such as a patient in an anoxic condition.

A pressure relief valve 34 (as shown in FIG. 8) is positioned on the outer surface of the chamber 12. The relief valve 34 is in fluid communication with an interior of the chamber 12, and is provided to maintain the pressure within the chamber 12 below a threshold value. The relief valve 34 is automatically if threshold safety values for the various parameters are reached.

As shown in FIG. 8, a manometer 36 is positioned on an exterior surface of the chamber 12, optionally adjacent to the pressure inlet 30. The manometer 36 is in fluid communication with an interior of the chamber 12, so as to indicate a pressure within the chamber 12 from viewers standing outside of the chamber 12.

The pressure generator 14 is typically a compressor, pressurizing ambient air to a desired pressure. The compressor is typically electrically actuated, and as suitable pressure monitoring means (e.g., manometer) so as to maintain the desired pressure. The pressure generator 14 is typically sized so as to enable a hyperbaric treatment in the chamber 12 of approximately 30 psig (as an example only).

Considering that the output of the compressor is fed to the chamber 12 as a pressure supply, the compressor is typically an oil-free compressor. The compressor is therefore preferably a medical-grade compressor, or other compressor outputting breathable air. A filtration device 30C is also typically provided at an outlet of the pressure generator 14/hypoxic generator 15, to remove air-laden particles, oil and humidity from the air.

The hypoxic generator 15 is typically an oxygen/nitrogen generator (e.g., with gas-permeable membranes for the separation of oxygen from nitrogen), that adjusts a concentration of oxygen/nitrogen as requested for the treatment of the user person. Therefore, by being in fluid communication with the interior of the chamber 12, the hypoxic generator 15 adjusts the concentration of oxygen/nitrogen in the chamber 12. The hypoxic generator 15 typically uses the output of the pressure generator 14, to bring the air to suitable pressure for being fed to the chamber 12, and a humidifier. The pressure generator 14 and the hypoxic generator 15 are therefore put in series by the valves 30A and 30B.

It is therefore contemplated to perform a hypoxic treatment in the chamber 12, by which air is fed with a concentration of nitrogen comparable to that found at high altitudes, and a pressure of approximately 1 psig for example. In the hypoxic treatment, the static pressure in the chamber 12 is typically slightly above that of atmospheric pressure.

A mask (not shown) may be provided within the chamber 12, and in connection with the oxygen source 16, to feed the controlled air mixture directly to the occupant of the chamber 12, with control through valve 35.

An oxygen meter associated with the air content controller 31 is provided in fluid communication with the chamber 12, so as to be have the readings visible to the operator outside of the chamber 12. The oxygen meter will provide oxygen content data, and will signal limits to the operator. More specifically, if the oxygen content of the air is too high, the oxygen meter will emit a sound signal, as well as a light signal, to warn the occupant of the chamber 12. In addition to being powered by the main power source powering the hyperbaric/hypoxic chamber system 10, the oxygen meter and carbon dioxide meter (also associated with the air content controller 31) will have their own autonomous power supply to ensure that dangerous levels of oxygen and of carbon dioxide in the air are signaled to the operator. Monitors and like interfaces are provided with the chamber system 10 to provide treatment data.

It is preferred that the various components interacting with the chamber 12 be connected directly to the end frame 23 or the door assembly 24, as the parts are made of rigidly materials well suited to be connected to fittings and other types of connectors.

The hyperbaric/hypoxic chamber system 10 is well suited for transportation. The various parts of the structure 20 is typically made of rigid materials having high strength-to-weight ratios. The longitudinal beam members 22 are preferably detachable from the end frame 23 and the door assembly 24, in such a way that the chamber 12 may be disassembled. The hyperbaric/hypoxic chamber system 10 is therefore portable, as it is considered to nest the small end of the chamber into its larger end in the case of the frusto-conical embodiment of FIGS. 1 to 6, with the body 21 accumulating in a folded condition between the end frame 23 and the door assembly 24.

It is pointed out that only one of the longitudinal beam members 22 is required to maintain the body 21 in the taut condition. For instance, it is considered to use the support frame 25 as a longitudinal beam member that will connect to the end frame 23 and the door assembly 24 to maintain the body 21 in the taut condition.

Figure 2:
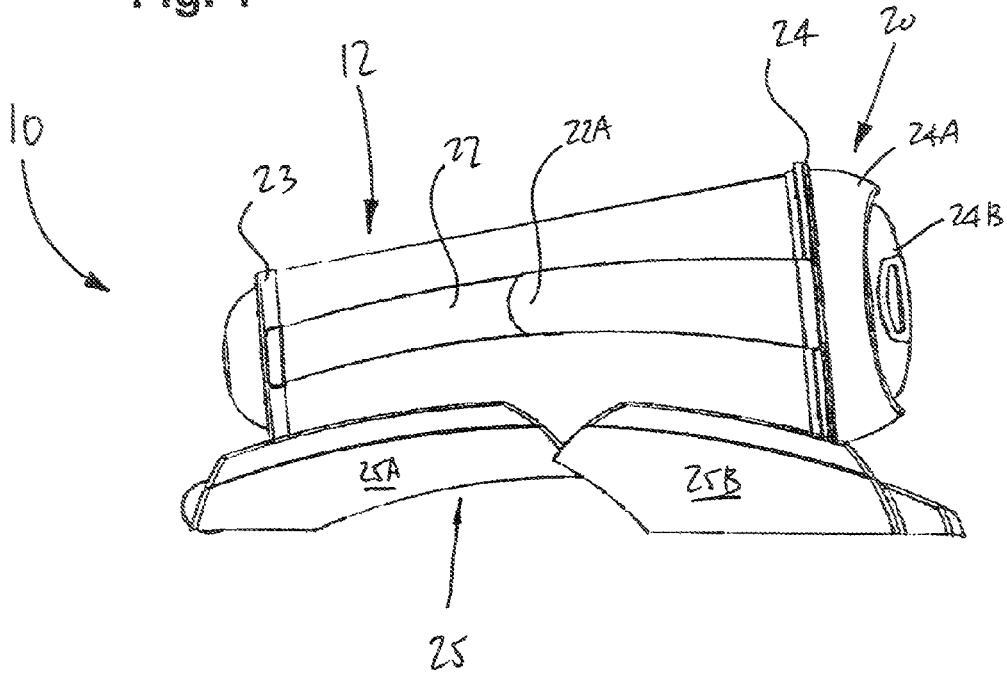
FIG. 2 is a side elevation view of the hyperbaric/hypoxic chamber system of FIG. 1.
Figure 3:
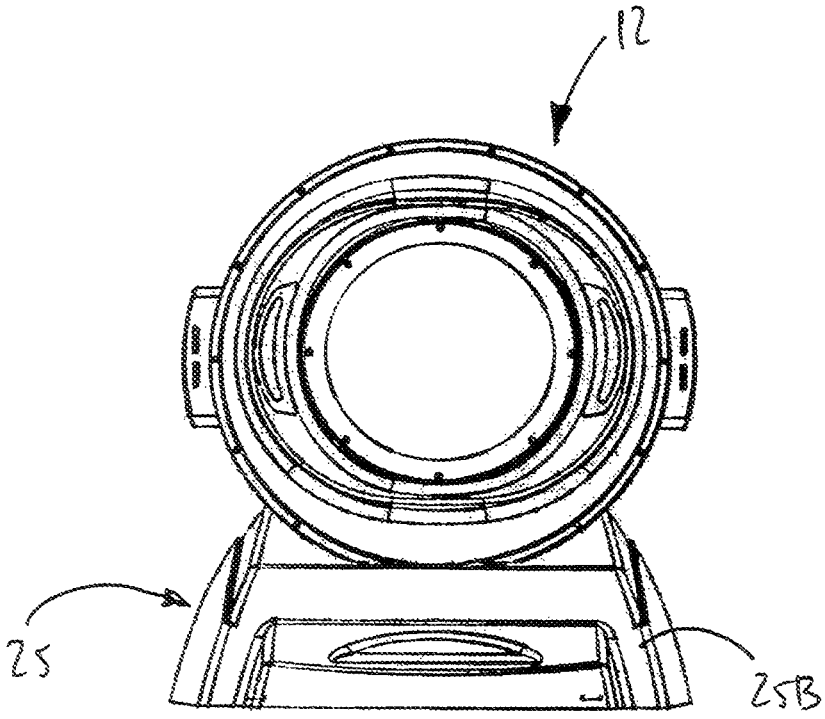
FIG. 3 is a front elevation view of the hyperbaric/hypoxic chamber system of FIG. 1.
Figure 4:
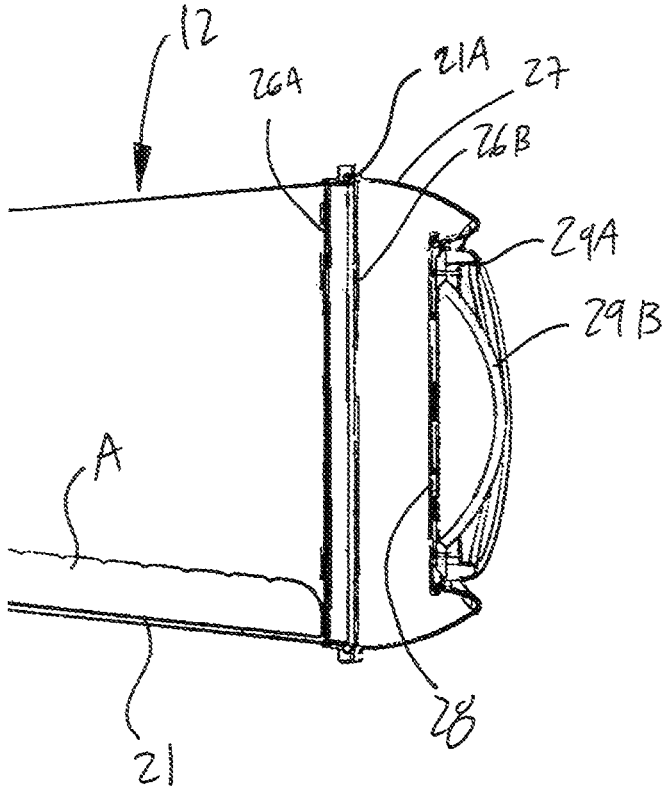
FIG. 4 is a sectional view of a door assembly of the hyperbaric/hypoxic chamber system of FIG. 1.

In another embodiment, as is shown in FIG. 2, the support frame 25 is formed of a pair of shells 25A and 25B, interconnected to form a case or luggage in which the chamber 12 will be accommodated during transportation. In the embodiment of FIG. 2, the shells 25A and 25B are pivotally connected to one another.

Moreover, in another embodiment, all pressure controls are integral with the support frame 25, to facilitate the installation and use of the chamber system 10. Accordingly, after the chamber 12 is deployed to its taut condition, piping is connected to the various inlets/outlets of the chamber 12 and the chamber system 10 is ready for operation.

The invention claimed is:

1. A portable chamber for hyperbaric treatment comprising:

a tubular body sized so as to accommodate at least one occupant, the tubular body being made of a non-rigid material and being collapsible for transportation;

end frames secured to opposed ends of the tubular body to close off the tubular body, with at least one of the end frames having a door displaceable from a remainder of the end frame to provide/close access for the at least one occupant to an interior of the tubular body; and a support frame distinct from the end frames and the tubular body and configured to support the tubular body in taut condition on the ground during use, the support frame comprising a pair of shells, the pair of shells being connectable to form a case for transportation, the case being configured to receive the tubular body in collapsed condition and the end during transportation;

wherein the portable chamber is configured to be in fluid communication with a pressure generator so as to receive an air supply from the pressure generator to increase a pressure in the interior of the tubular body for hyperbaric treatment.

2. The portable chamber according to claim 1, further comprising at least one longitudinal beam member detachably connectable at opposed ends to the end frames so as to maintain the tubular body in a taut condition between the end frames.

3. The portable chamber according to claim 2, comprising two of the longitudinal beam member, with each of the longitudinal beam member being extendable to an extended position in which the tubular body is in the taut condition.

4. The portable chamber according to claim 3, further comprising a locking mechanism to lock at least one of the longitudinal beam members in the extended position.

5. The portable chamber according to claim 2, wherein the at least one longitudinal beam member is separated from the end frames during transportation and received into the case.

6. The portable chamber according to claim 1, wherein the tubular body has a frusto-conical geometry, with the end frame having the door being on a larger one of the end frames.

7. The portable chamber according to claim 6, wherein when the tubular body is in collapsed condition, the end frames are nested one into another during transportation.

8. The portable chamber according to claim 1, wherein the tubular body has a cylindrical geometry, with the end frames each having a door to provide access or to close access for the at least one occupant to the interior of the tubular body.

9. The portable chamber according to claim 1, wherein the support frame incorporates the pressure generator.

10. The portable chamber according to claim 1, wherein at least one of the end frames has ring-shaped bodies sandwiching a periphery of an open end of the tubular body, with the door being supported peripherally by the ring-shaped bodies.

11. The portable chamber according to claim 10, wherein the door has a see-through panel forming a window.

12. The portable chamber according to claim 1, further comprising handrails extending between end frames in the tubular body.

13. A hyperbaric chamber system comprising:

a pressure generator;

a hypoxic generator;

a collapsible and portable chamber, sized so as to accommodate at least one occupant, the chamber being configured to be in fluid communication with the pressure generator so as to receive a supply of air from the pressure generator to increase a pressure in the chamber for hyperbaric treatment, and to be in fluid communication with the hypoxic generator so as to receive a supply of air with a selected nitrogen/oxygen ratio to adjust an oxygen content in the chamber for hypoxic treatment;

a support frame distinct from the portable chamber and configured to support the portable chamber in taut condition on the ground during use, the support frame comprising a pair of shells being connectable to form a case configured to accommodate the portable chamber in collapsed condition during transportation, the case incorporating the pressure generator, the hypoxic generator and a control system for controlling conditions in the portable chamber during hyperbaric/hypoxic treatments.

14. The hyperbaric chamber system according to claim 13, further comprising an oxygen source for outputting oxygen-rich air, the oxygen source being connectable to the chamber to feed oxygen in the chamber.

15. The hyperbaric chamber system according to claim 14, further comprising a mask in the chamber, the mask being connectable to the oxygen source to feed oxygen directly to the at least one occupant of the chamber.

16. The hyperbaric chamber system according to claim 13, wherein the chamber comprises a tubular non-rigid body and a pair of end frames, with the pressure generator, the hypoxic generator and the control system being all connectable to at least one of the end frames for fluid communication with an interior of the chamber.

17. A hyperbaric chamber system comprising:

a portable chamber, sized so as to accommodate at least one occupant, the chamber being configured to be in fluid communication with a pressure generator so as to receive an air supply from the pressure generator to increase a pressure in the chamber for hyperbaric treatment, the portable chamber comprises a collapsible non-rigid tubular body maintained in a taut condition by a collapsible rigid structure; and a support frame for supporting the tubular body in taut condition on the ground during use, the support frame being distinct from the portable chamber, the support frame comprising a pair of shells being connectable to form a case for accommodating the portable chamber in a collapsed condition during transportation.

18. The hyperbaric chamber system according to claim 17, wherein the support frame incorporates the pressure generator, and a control system controlling conditions in the chamber during hyperbaric treatments.

* * * * *